US009205316B2

(12) United States Patent
Fishman

(10) Patent No.: US 9,205,316 B2
(45) Date of Patent: Dec. 8, 2015

(54) WEARABLE DEVICES FOR ASSESSMENT OF ATHLETIC PERFORMANCE

(71) Applicant: Pacebands, LLC, Middleton, MA (US)

(72) Inventor: Jamie M. Fishman, Middleton, MA (US)

(73) Assignee: Pacebands, LLC, Middleton, MA (US)

( * ) Notice: Subject to any disclaimer, the term of this patent is extended or adjusted under 35 U.S.C. 154(b) by 212 days.

(21) Appl. No.: 14/057,911

(22) Filed: Oct. 18, 2013

(65) Prior Publication Data

US 2014/0114452 A1 Apr. 24, 2014

Related U.S. Application Data

(60) Provisional application No. 61/716,489, filed on Oct. 20, 2012.

(51) Int. Cl.

| | |
|---|---|
| ***A63F 13/00*** | (2014.01) |
| ***A63B 69/00*** | (2006.01) |
| *A63B 71/06* | (2006.01) |

(52) U.S. Cl.

CPC ..... *A63B 69/0028* (2013.01); *A63B 2071/0602* (2013.01); *A63B 2071/0663* (2013.01); *A63B 2071/0688* (2013.01); *A63B 2071/0694* (2013.01)

(58) Field of Classification Search

CPC ..... A63B 24/0021; A63B 71/0622; A61B 5/02438; A61B 5/00; A61B 5/02

See application file for complete search history.

(56) References Cited

U.S. PATENT DOCUMENTS

| | | | |
|---|---|---|---|
| 8,011,124 | B1 | 9/2011 | Temples et al. |
| 2006/0179542 | A1 | 8/2006 | Pierce |
| 2009/0049722 | A1 | 2/2009 | Chan |

FOREIGN PATENT DOCUMENTS

| | | | |
|---|---|---|---|
| JP | 2003172787 | A | 6/2003 |
| KR | 1020090132019 | A | 12/2009 |

OTHER PUBLICATIONS

International Search Report and Written Opinion for International Application No. PCT/US2013/065724 mailed Feb. 26, 2014.

*Primary Examiner* — Reginald Renwick

(74) *Attorney, Agent, or Firm* — Sutherland Asbill & Brennan LLP

(57) ABSTRACT

Aspects of the disclosure relate to non-obtrusive, durable, reusable, lightweight, and/or affordable wearable devices for assessment of athletic performance during an athletic event, and techniques for supplying such wearable devices.

22 Claims, 10 Drawing Sheets

200

Marathon
PACE
3:30:00

1) 0:08:00
2) 0:16:01
3) 0:24:01
4) 0:32:02
5) 0:40:02
6) 0:48:03
7) 0:56:04
8) 1:04:04
9) 1:12:05
10) 1:20:05
11) 1:28:06
12) 1:36:06
13) 1:44:07
14) 1:52:08
15) 2:00:08
16) 2:08:09
17) 2:16:09
18) 2:24:10
19) 2:32:10
20) 2:40:11
21) 2:48:12
22) 2:56:12
23) 3:04:13
24) 3:12:13
25) 3:20:14
26) 3:28:14

PACE
3:30:00

FIG. 2A

250

10K
PACE
0:35:00

1) 0:05:37
2) 0:11:15
3) 0:16:53
4) 0:22:31
5) 0:28:09
6) 0:33:47

PACE
0:35:00

FIG. 2B

WEARABLE DEVICES FOR ASSESSMENT OF ATHLETIC PERFORMANCE

CROSS-REFERENCE TO RELATED APPLICATION

The present application is related to and claims priority from U.S. Provisional Patent Application 61/716,489, filed on Oct. 20, 2012, the entirety of which is incorporated herein by reference.

BACKGROUND

Conventional approaches that athletes commonly employ to assess performance information during competition or training generally are obtrusive and/or impractical. While certain conventional approaches may provide a marginal degree of non-obtrusive access to such information, those approaches are seldom adopted in view of their restrictive costs and usually fail to permit an athlete to compare a target performance to actual performance during competition or training.

BRIEF DESCRIPTION OF THE DRAWINGS

The accompanying drawings form part of the disclosure and are incorporated into the subject specification. The drawings illustrate example embodiments of the disclosure and, in conjunction with the present description and claims, serve to explain, at least in part, various principles, features, or aspects of the disclosure. Certain embodiments of the disclosure are described more fully below with reference to the accompanying drawings. However, various aspects of the disclosure can be implemented in many different forms and should not be construed as being limited to the implementations set forth herein. Like numbers refer to like elements throughout.

FIGS. 2A-2B present other examples of wearable devices for assessment of athletic performance in accordance with one or more aspects of the disclosure.

DETAILED DESCRIPTION

Figure 1A:
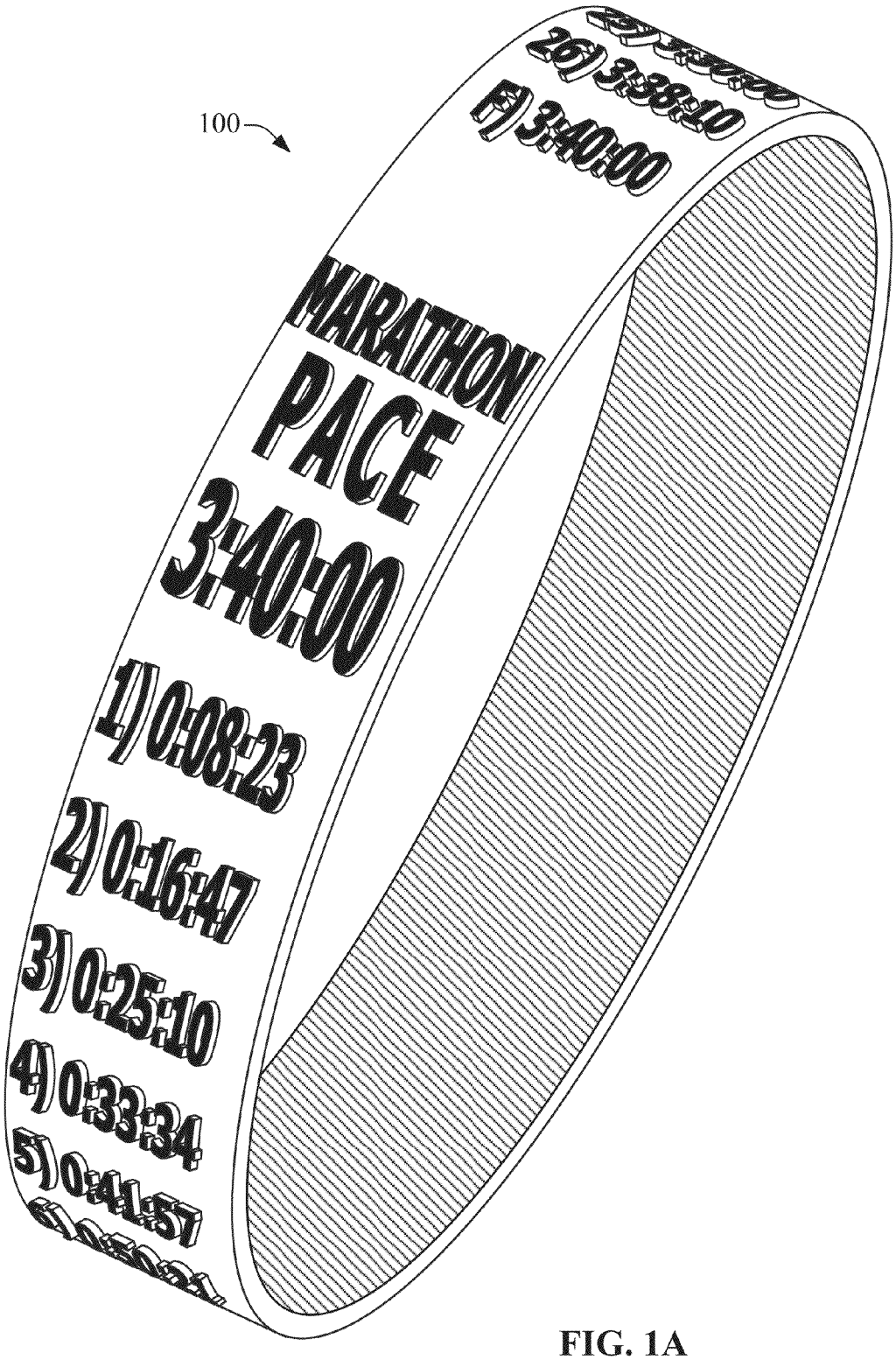
FIGS. 1A-1B present examples of wearable devices for assessment of athletic performance in accordance with one or more aspects of the disclosure.

The present disclosure recognizes and addresses, in at least certain aspects, the lack of unobtrusive and/or practical devices that permit tracking actual athletic performance versus a reference performance as the actual athletic performance is delivered. As described in greater detail below, the disclosure provides non-obtrusive, durable, reusable, lightweight, and/or affordable wearable devices that permit (i) accessing athletic performance information (e.g., data and/or metadata) indicative or otherwise representative of a target athletic performance and/or critical athletic performance information, and (ii) evaluating such information versus information indicative or otherwise representative of actual athletic performance during an athletic event. It should be appreciated that, in one aspect, critical athletic performance information can include information that permits or otherwise facilitates developing and/or implementing a strategy for athletic performance (e.g., a competition strategy). In one aspect, such critical information can permit making a determination that can affect athletic performance or the outcome of an athletic event (e.g., a running competition) during the athletic event. For instance, critical athletic performance information can be relied upon by an athlete as a guide to energy expenditure and/or other facets of competition strategy. Such wearable devices can have embedded or otherwise integrated thereon the athletic performance information, which is specific to the athletic event (e.g., a running training session; a running competition; a running endurance session (such as a running session directed to running unusual distances); a swimming training session; a swimming competition; a swimming endurance session (such as a swimming session directed to swimming unusual distances, for example, swimming across the English Channel); a cycling training competition; a cycling endurance session; a combination thereof; or the like). In certain embodiments, the wearable devices can be formed from a flexible solid substrate that can be treated in order to record the athletic performance information. As an illustration, the flexible solid substrate can be embodied in or can comprise a silicone slab, a rubber slab (either natural or synthetic, such as a neoprene slab), a slab of a fibrous flexible material, a slab of a composite material, a combination thereof, or the like. In other embodiments, other solid substrates (e.g., a malleable substrate) can be utilized to form a wearable device in accordance with aspects of the disclosure, where such substrates can be treated in order to record the athletic performance information. Such substrates can be substantially planar and can be arranged or otherwise assembled to fit a member (e.g., an extremity or limb) associated with an athlete. For instance, the flexible substrate can be bent to form an opening configured to receive one of the athlete's hand, wrist, and/or forearm.

For an athletic event, in one aspect, an athlete can select a wearable device of the disclosure having customized athletic performance information indicative or otherwise representative of the athlete's target athletic performance for the athletic event, and can monitor or otherwise access such information as the athletic event occurs. In a scenario in which the athletic event is a running session (either competitive or preparative) over a predetermined distance, the customized athletic performance information can include a group of performance information structures indicative of respective competition milestones associated with traveling the predetermined distance in a predetermined time interval. A competition milestone can be embodied in or can comprise an instant indication of a time interval that has elapsed while traveling a portion of the predetermined distance. Such an instant may be referred to as a "split" or "race split." Accordingly, in one aspect, the group of information structures can be indicative of a time sequence associated with traveling the predetermined distance during a net time interval. The time sequence may be referred to as a sequence of splits. For the predetermined distance (e.g., 100 kilometers, a marathon distance, a half-marathon distance, a 10 kilometer (10K) race distance, a five kilometer (5K) race distance, and the like), each race split of the sequence of race splits can represent or otherwise convey a desired pace for traveling a portion of the predetermined distance. In addition, a time interval determined by the difference between consecutive race splits in the sequence of race splits can represent or otherwise convey the pace milestone or reference distance within the predetermined distance. Accordingly, the predetermined distance can be partitioned into a non-empty set of distance portions, the sequence of race splits can be generated to represent or otherwise convey a desired pace for each portion (e.g., a mile, a kilometer, a half mile, or the like) of the group of distance portions. The number of splits in the sequence of race splits can equate the cardinality of such a set. The athlete wearing the selected wearable device can access the sequence of splits as the running session progresses in order to monitor in situ (or during the running session) the athlete's actual performance with respect to the target athletic performance. Based at least on the actual performance, such an athlete can adjust athletic throughput in order to achieve the target athletic performance. Embodiments of the disclosure can persist on every possible performance achievable within the ranges of times to the physical form factors so that athletes of any shape, size, or physical ability could find a data set to use during their competition.

The disclosure also provides techniques for generating the wearable devices described herein. In one aspect, target athletic performance information can be generated for an athletic event. In a scenario in which the athletic event is a running session, the target athletic information can include information representative or otherwise indicative of a sequence of race splits associated with traveling a predetermined distance in a predetermined time. It should be appreciated that, in one aspect, the predetermined distance (e.g., a marathon distance) can characterize the scope of the running session, and the predetermined time (e.g., three hours and forty minutes) can establish a performance outcome for the running session. In certain embodiments, the splits in a sequence of race splits can be homogenously distributed, e.g., a difference between a first split and a second split of the sequence of splits is substantially constant throughout the entire sequence of splits. Such a difference corresponds to a time interval elapsed while traveling a substantially fixed distance interval. In one of such embodiments, the pace for traveling the substantially fixed distance interval is substantially constant. In other embodiments, the sequence of splits can be non-homogeneously distributed, where a time difference between a first split and a second split of the sequence of splits has a magnitude that is based on the specific pair of first and second splits. Non-homogeneous distribution of race splits in a sequence of splits can be originated at least in part in non-homogeneities in the degree of effort necessary to perform athletically in the underlying course of an athletic event. For example, in a running session, certain portions of the running course may include hills or muddy terrain, which can alter the running pace in such portions of the running course with respect to the running pace in other portions of the running course.

In addition, target athletic performance information that is generated as described herein can be imparted to or otherwise embedded on a wearable device (e.g., a bracelet) as described herein in order to render such information accessible during an athletic event. To at least such an end, in one aspect, at least a portion of the wearable device can be treated via a process configured to impart to or otherwise embed on the wearable device at least a portion of the target athletic performance information. In certain embodiments, the process can include an additive process (e.g., printing, coating, a combination thereof, or the like), a subtractive process (e.g., etching, or the like), a transformative process (such as embossing and/or debossing, or the like), a combination thereof, or the like. In one aspect, markings can be generated or otherwise provided in order to impart to or otherwise embed on the wearable device at least the portion of the athletic performance via the process(es) described herein.

Embodiments of the disclosure can provide various advantages and/or improved efficiencies over conventional technologies that track athletic performance versus a target or otherwise desired performance. An example advantage is that a disclosed wearable device having athletic performance information embedded or otherwise integrated thereon is non-obtrusive and durable, with such information being persisted onto the wearable device without substantial deterioration due to at least moisture and/or mechanical strain that may be present prior to, during, and/or after an athletic event. In contrast, one of the conventional technologies for monitoring athletic performance relies on printed paper having a listing of race splits intended for competition. The paper typically is carried during the competition, which is not only inconvenient to the athlete carrying the paper, but it can result in tears, stains, ink smudges from moisture, and the like. In addition, there is no convenient way to carry the paper during competition in a manner that ensures the paper does not detract from the athlete's performance throughput. Further, other conventional technologies rely on mobile telephones (such as smartphones) and personal digital assistants (PDAs). Although such devices can provide a range of computing resources for monitoring athletic performance, a mobile telephone or a PDA usually are impractical to carry during competition or training. In addition to improved practicality and durability, another example advantage is that the disclosed wearable devices according to aspects of the disclosure are economic and provide higher value than conventional devices that may be utilized to monitor athletic performance. In contrast, certain conventional technologies for monitoring athletic performance rely on portable electronic devices having different complexity (e.g., portable global positioning system (GPS) receivers, smartphones, PDAs) that the athletes can strap to their wrists or extremities. Yet, such devices generally are expensive and, thus, access to such devices may be limited. Yet another example advantage of the wearable devices disclosed herein is that athletic performance information is available to an athlete without relying on a portion of the skin of the athlete wearing one of the devices. Accordingly, a wearable device containing athletic performance information, in accordance with aspects described herein, can permit access to such information during an athletic event regardless of the garments the athlete may be wearing, thus freeing the athlete from athletic attire restrictions. In addition, such wearable devices are substantially unaffected by friction and substantially impervious to moisture. In contrast, conventional technologies that rely on a tattoo to convey athletic performance information typically require an athlete to wear garments that permit visibility of the tattoo in order to access such information. It would be readily appreciated that in certain weather conditions, portion(s) of the garments the athlete may be wearing can obstruct the visibility of the tattoo. In cold weather, for example, it may be impractical or undesirable for the athlete to wear garments that permit visibility of the tattoo because the garment would require having the skin with the tattoo remain uncovered and vulnerable to the temperature. In still another example advantage, the wearable devices in accordance with aspects of the disclosure may retained and, thus, can permit an athlete to collect various wearable devices representing various increasingly better athletic performances in order to tangibly memorialize the journey of an athlete towards a specific performance goal. Such motivational value typically is absent in conventional technologies.

Figure 1B:
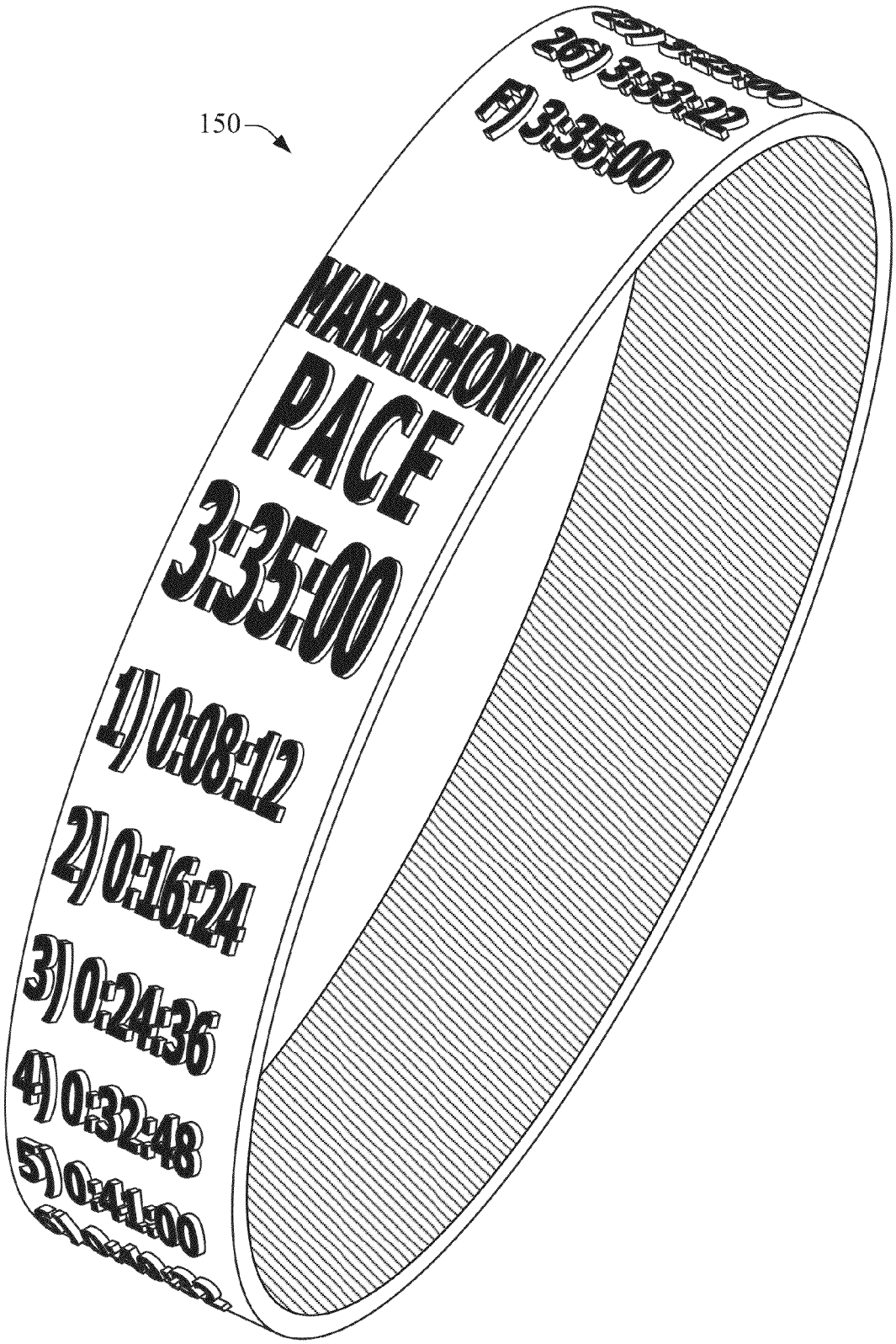
Figure 3:
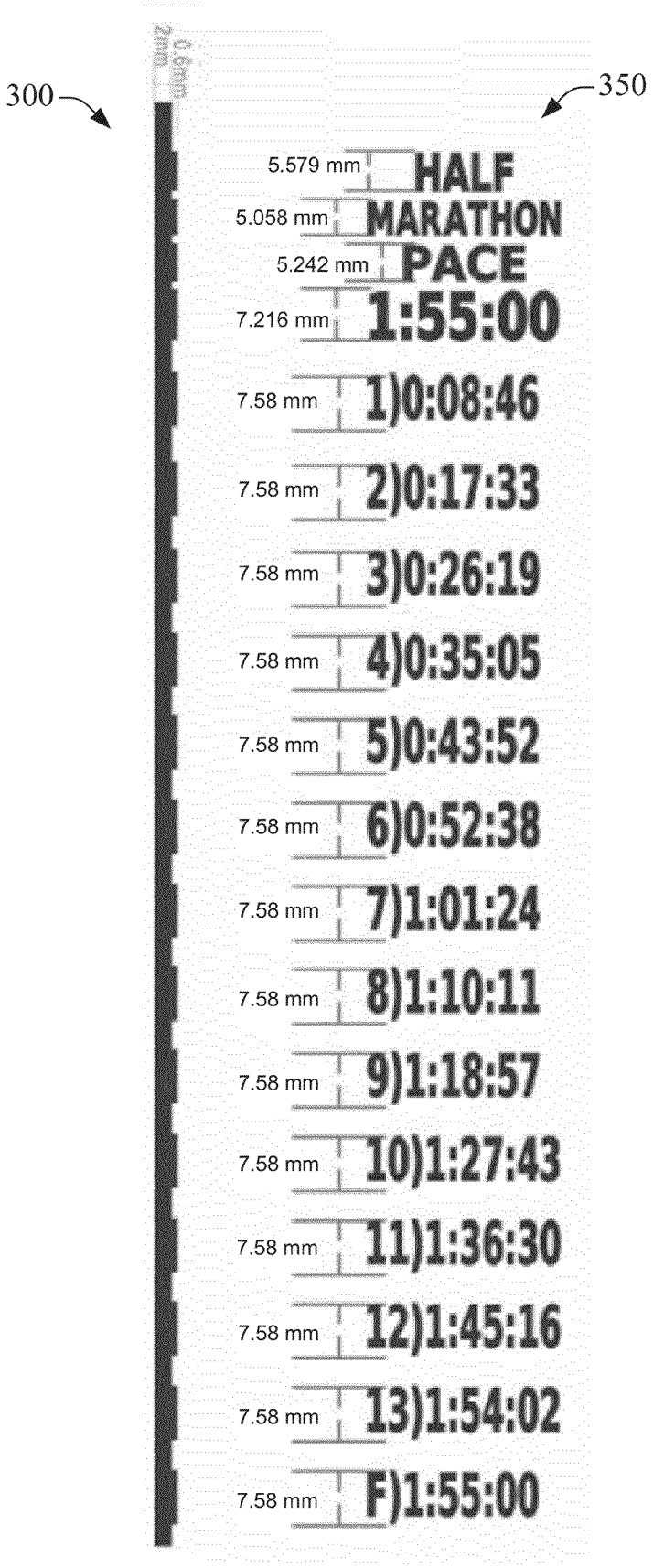
FIGS. 3-6 present yet other examples of wearable devices including examples of markings configured to convey athletic performance information in accordance with one or more aspects of the disclosure.

With reference to the drawings, FIGS. 1A-1B present example wearable devices 100 and 150, respectively, for assessment of athletic performance in accordance with one or more aspects of the disclosure. Such wearable devices can be formed from a substrate comprising a flexible solid that is substantially planar, and can be bent to form an opening configured to receive one of the athlete's hand, wrist, and/or forearm. The substrate can be colored (e.g., pigmented, painted, coated, a combination thereof, or the like) according to a desired or otherwise specified color or arrangement of colors. Colored substrates can permit customization of the wearable devices that may appeal to a wide segment of consumers (e.g., athletes or sport enthusiasts). As an illustration, the substrate can be embodied in or can comprise a silicone slab, a rubber slab (either natural or synthetic, such as a neoprene slab), a slab of a fibrous flexible material, a slab of a composite material, a combination thereof, or the like. In addition, each of the example wearable device 100 and the example wearable device 150 may include markings indicative of a time sequence associated with traveling a predetermined distance during a predetermined time interval. As described herein, such a time sequence embodies the sequence of race splits associated with a desired target performance. The example wearable device 150 includes markings embossed into the substrate. As illustrated, the markings define respective protrusions substantially uniformly distributed over a portion of a surface of the substrate, and are indicative of a time sequence associated with traveling a marathon distance during a predetermined time interval of three hours and forty minutes (labeled as "3:40:00") as shown in FIG. 1A.

FIGS. 2A-2B present other example wearable devices 200 and 250, respectively, for assessment of athletic performance in accordance with one or more aspects of the disclosure. As illustrated, the wearable device 200 is embodied in a bracelet that targets a marathon performance of three hours and thirty minutes (labeled as "3:30:00"), where the desired race split interval is one mile. A marathon spans a distance of 26 miles and 385 yards. Thus, as illustrated, the target athletic performance information embedded on the wearable device 200 includes a sequence of 26 race splits (one race split per mile) that tracks the cumulative time for the distance. The target athletic performance includes a time interval of eight minutes (labeled as "0:08:00") to travel the first mile, and a cumulative time through mile 17 of two hours and sixteen minutes (labeled as "2:16:09"). Cumulative times for respective splits after the first mile and subsequent to mile 17 increase in intervals of about eight minutes. Review and analysis of the data readily demonstrates that it is impractical for an athlete to be expected to manually compute the information that permits tracking the athlete's desired performance.

In addition, the example wearable device 250 is embodied in a bracelet that targets a race distance of 10,000 meters, commonly referred to as a "10K" race. The target athletic information conveyed in the example wearable device 250 includes fewer one-mile splits than in the sequence of race splits in the wearable device 200 because a 10K race spans a distance of about six miles. It should be appreciated that, in one aspect, other wearable devices in accordance with aspects of the disclosure can be supplied for a 10K race and can include splits for every kilometer. In such a scenario, the target athletic information that is imparted to or embedded on the wearable device 250 can include ten one-kilometer splits each conveying a cumulative time associated with traveling at least a portion of such a race's distance.

Figure 4:
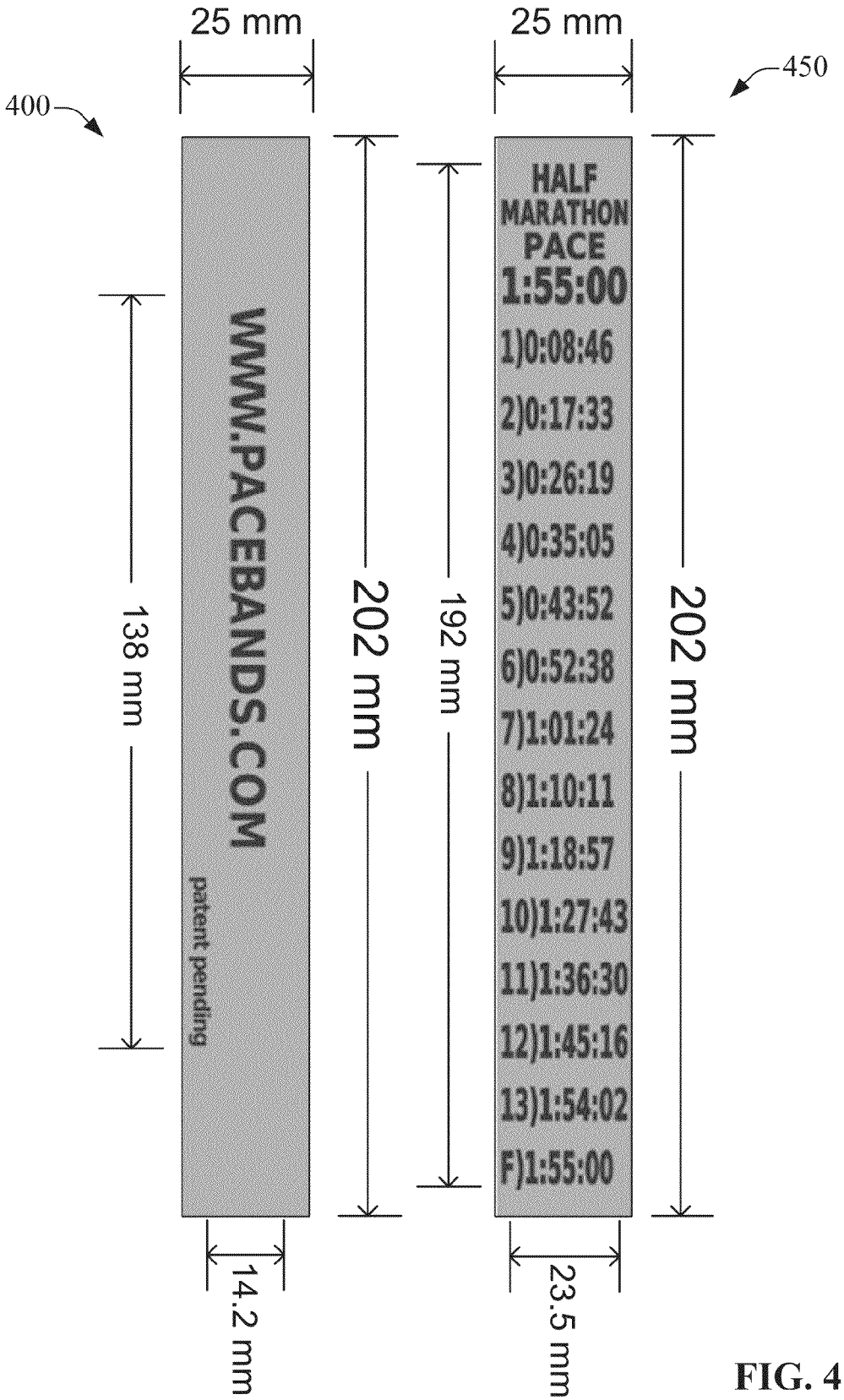
Figure 5:
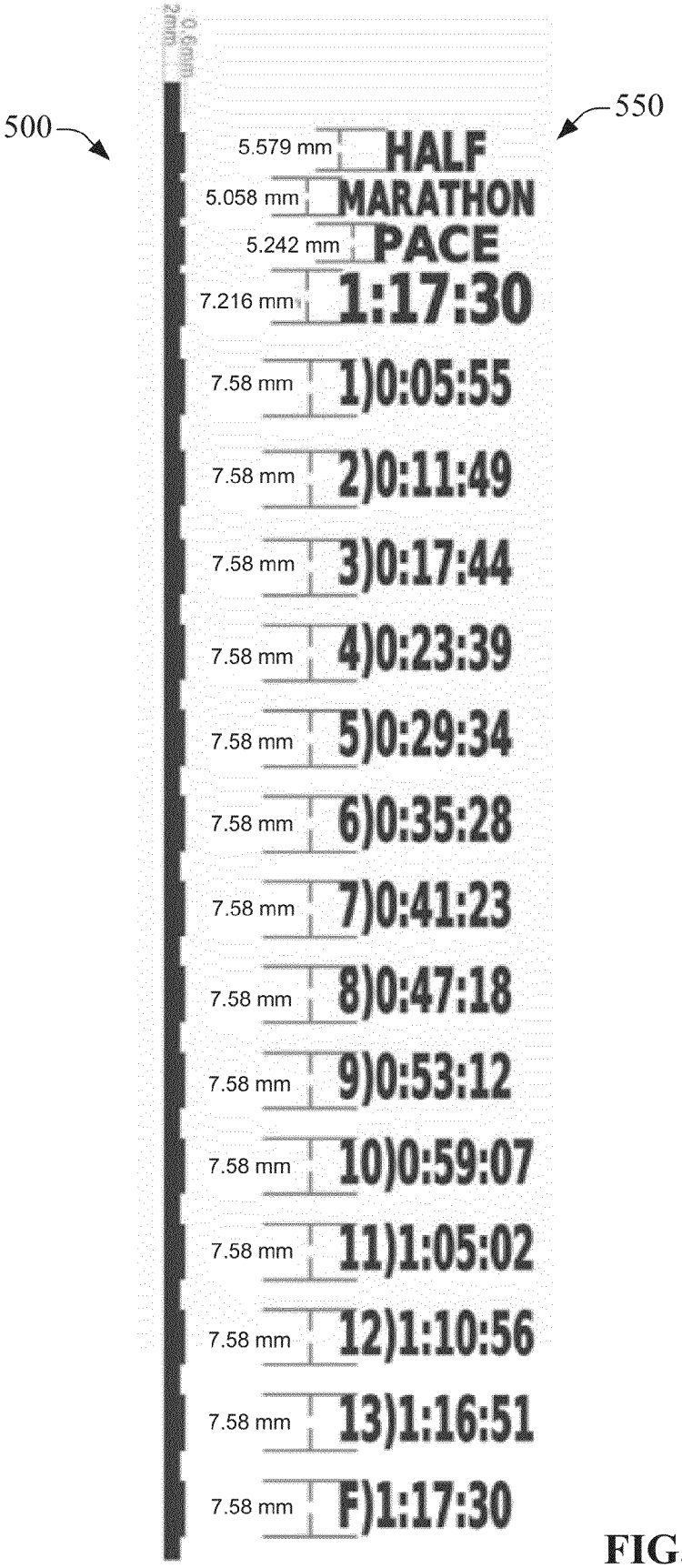
Figure 6:
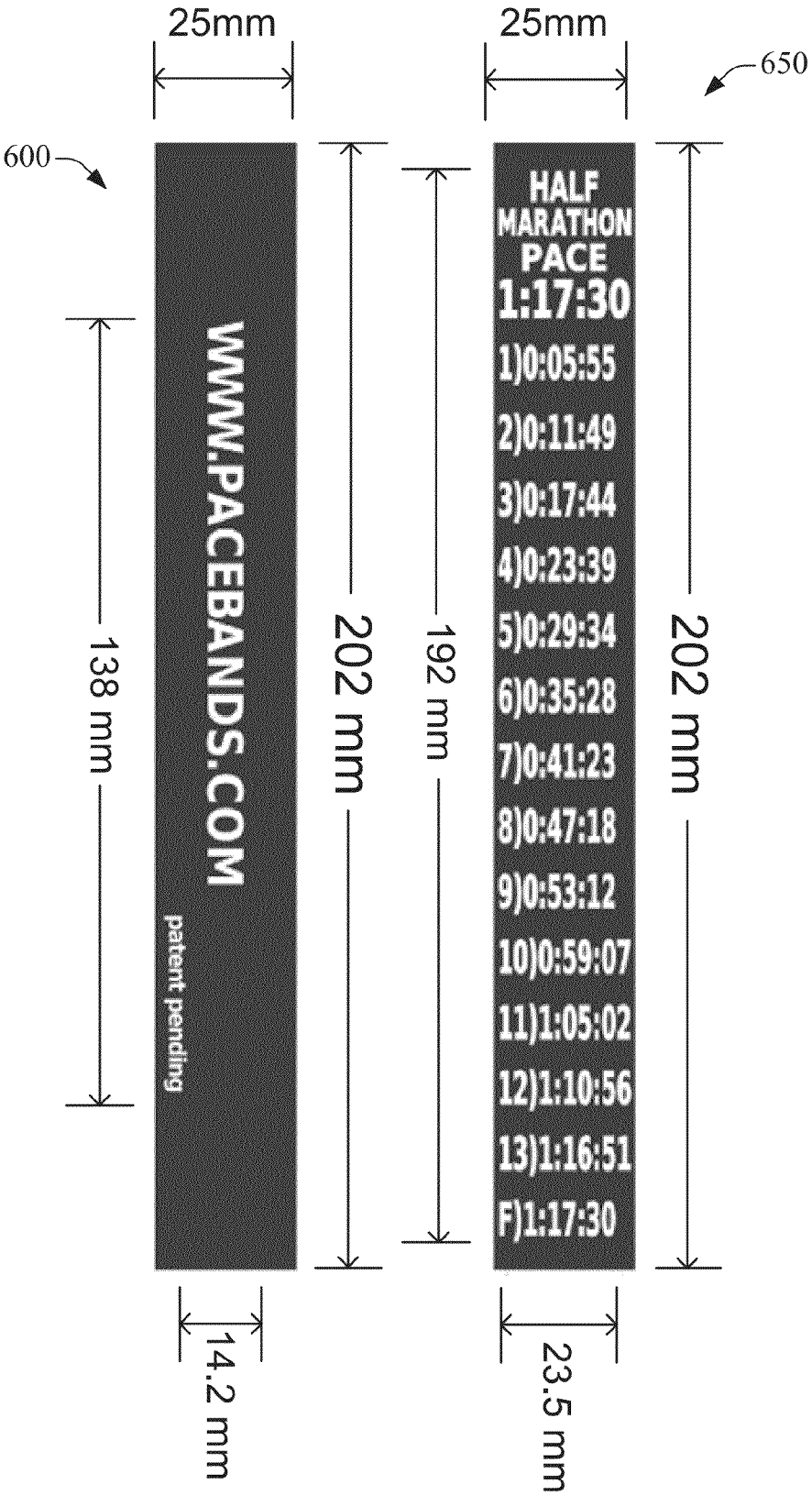

FIGS. 3-6 illustrate other examples of wearable devices in accordance with one or more aspects of the disclosure. Such example wearable devices include examples of markings configured to convey athletic performance information. In one aspect, diagram 300 illustrates a side view of an example wearable device comprising target athletic performance information and associated markings in accordance with aspects of the disclosure. As illustrated, diagram protrusions are represented as portions of increased thickness in the side-view diagram. Further, the wearable device illustrated in diagram 300 has a thickness of about 2.0 mm in regions that do not include a protrusion associated with a marking and a thickness of about 2.6 mm in regions that include a protrusion associated with a marking. Diagram 350 illustrates the arrangement of such markings. It should be appreciated that such an arrangement can be determined in accordance with various aspects of the disclosure and are presented as an example. In FIG. 4, diagrams 400 and 450 illustrate, respectively, the inner and outer surface of the example wearable device illustrated in FIG. 3. The outer surface of such a device contains target athletic information for a half marathon, with a target completion time of one hour and fifty-five minutes (labeled as "F) 1:55:00") and 15 splits. As illustrated the width of the device is about 25 mm and the length is about 202 mm. In addition, the markings in the outer surface are arranged within a surface having a length of about 192 mm and a width of about 23.5 mm. Similarly, diagram 500 in FIG. 5 illustrates another example wearable device having a marking indicative of target athletic performance information for a half marathon intended to be completed at a higher pace than that associated with the example wearable device in FIG. 3. As illustrated, diagram 500 is a side-view representation of the wearable device, and protrusions are represented as portions of increased thickness. Further, the wearable device illustrated in diagram 500 has a thickness of about 2.0 mm in regions that do not include a protrusion associated with a marking and a thickness of about 2.6 mm in regions that include a protrusion associated with a marking. Diagram 550 presents an example arrangement of markings that are indicative of such information. In addition, diagrams 600 and 650 illustrate, respectively, the inner and outer surface of the example wearable device illustrated in FIG. 5.

While various markings representative or otherwise indicative of target athletic performance are disclosed herein, it should be appreciated that, as described herein, a specific arrangement of such markings can be determined based at least in part on one or more acceptance criteria. Accordingly, other arrangements for such markings can be implemented and are contemplated within the present disclosure. In addition, in certain implementations, the information contained or otherwise embedded in the inner surface of a wearable device in accordance with aspects of the disclosure may be customized to an end-user associated with the wearable device.

Figure 7:
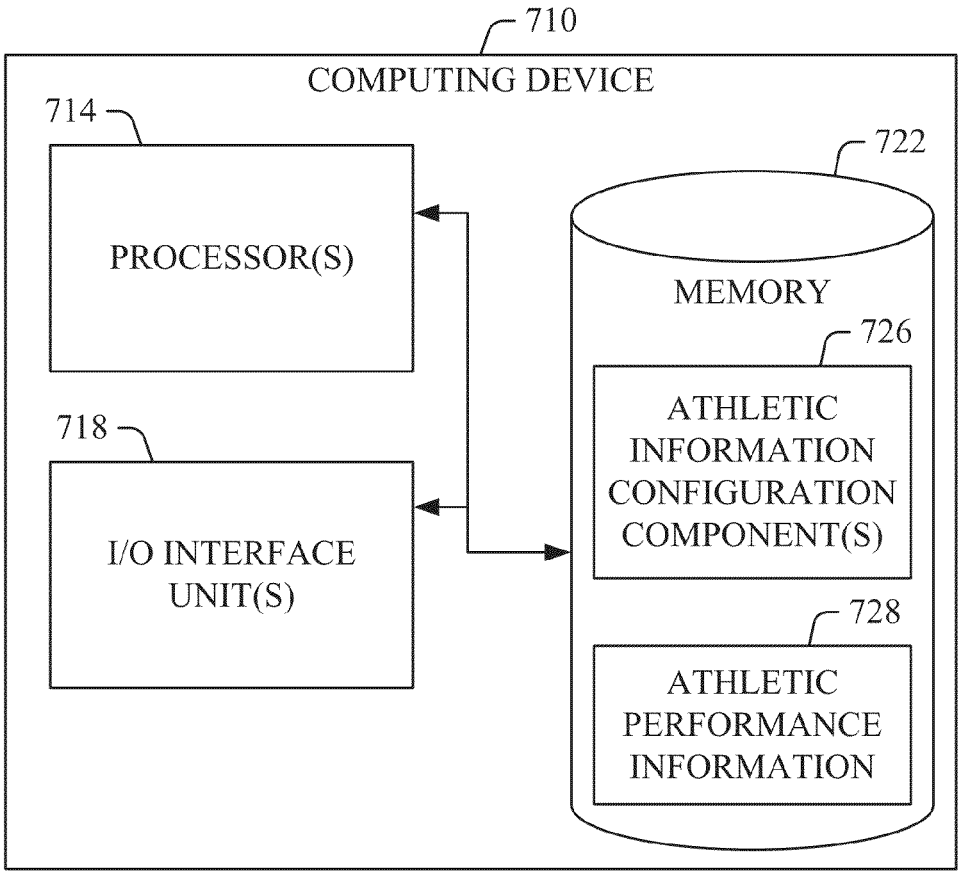
FIG. 7 presents a block diagram of an example of a computing device in accordance with one or more aspects of the disclosure.

As illustrated in FIG. 7, a computing device 710 having at least one processor (referred to as "processor(s) 714") and at least one information storage device (which may be referred to as a "memory device 722" or "memory 722") can supply or otherwise provide target athletic information in accordance with aspects of the disclosure. The computing device 710 can be programmed or otherwise configured by machine-accessible instructions to supply (e.g., access, generate, transmit, combinations thereof, or the like) such target athletic information in response to execution of at least a portion of the machine-accessible instructions. In response to such programming or configuration, the processor(s) 714 can be arranged to perform at least some of the functionality of the computing device 710, and/or carry out at least some of the operations described herein. At least a portion of the machine-accessible instructions (e.g., computer-readable and/or computer-executable instructions) can be persisted (e.g., stored, made available, or stored and made available) or otherwise retained in the memory 722, and can be arranged or otherwise configured into one or more athletic information configuration component(s) 726. In certain implementations, such component(s) can be assembled into one or more program modules that can be compiled, linked, and/or executed at the computing device 710 or other computing devices. Generally, such program modules comprise computer code, routines, programs, objects, components, information structures (e.g., data structures and/or metadata structures), etc., that can perform particular tasks (e.g., one or more operations) in response to execution by one or more processors, which can be integrated into the computing device 710 or functionally coupled thereto.

In certain embodiments, in response to the execution of certain portion(s) of the machine-accessible instructions, the computing device 710 can generate athletic performance information comprising information (e.g., data, metadata, and/or signaling) indicative of a sequence of race splits (e.g., a time sequence) associated with traveling a predetermined distance during a predetermined time interval. As illustrated, such athletic performance information can be persisted or otherwise retained in one or more athletic information configuration component(s) 726 (e.g., register(s), file(s), database(s), combinations thereof, or the like). In one aspect of generating such information, in response to the execution of machine-accessible instruction(s), the computing device710 can receive a group of information structures (e.g., numeric variables) indicative or otherwise representative of target hours, minutes, and/or seconds associated with the predetermined time interval. In another aspect, in response to the execution of machine-accessible instruction(s), the computing device 710 can receive or otherwise acquire another group of information structures indicative or otherwise representative of a split interval (e.g., every mile, kilometer, or the like). As described herein, at least one of the processor(s) 714 can execute the machine-accessible instructions. Based on the predetermined distance (e.g., a marathon distance, a 10K race distance, a 5K race distance, or the like), the split interval can establish a number of race splits present in the sequence of race splits—such a number also may be referred to as the cardinality of the sequence of race splits. In yet another aspect, in response to the execution of machine-accessible instruction(s), the computing device 710 can determine a number of seconds per split interval. To at least such an end, a division of the number of seconds in the predetermined interval by the number of race splits minus one can be calculated. In still another aspect, in response to the execution of machine-accessible instruction(s), the computing device 710 can access the number of seconds per split interval, and convert or otherwise format such a number into a specific time represented as a combination of hours, minutes, and seconds. In a further aspect, in response to execution of machine-accessible instruction(s), the computing device can determine a cumulative number of seconds at each race split of the sequence of race splits, and format or otherwise represent the cumulative number of seconds as a combination of hours, minutes, and seconds representative of the cumulative time at each race split of the sequence of race splits.

In one or more of such implementations, in response to the execution of a portion of the machine-accessible instructions, the computing device710 can generate marking information indicative of markings configured to convey at least a portion of the athletic performance information on a wearable device described herein. At least a portion of the marking information can be retained in the one or more memory element(s) 728 referred to as athletic performance information 728. In one aspect, the computing device 710 can format or otherwise configure the marking information to be rendered or otherwise provided as an image that can permit embedding at least a portion of the marking information on the wearable device. For example, the marking information can be formatted according to portable document format (PDF). Other formats for conveying graphical and/or textual information (such as tagged image file format (TIFF), joint photographic experts group (JPEG) format, bitmap (BMP) file format, and the like) also are contemplated in the present disclosure. As an illustration, FIGS. 3-6 present examples of markings configured to convey athletic performance information and example images containing such markings in accordance with one or more aspects of the disclosure.

As an illustration, the computing device 710 described herein can execute machine-accessible instructions to supply or otherwise provide target athletic performance information for a running event in accordance with a specific (e.g., desired or otherwise predetermined) sequence of race splits. In response to the execution of such instructions, the computing device 710 can generate athletic information and/or markings to convey such information for any or almost any finish time for the running event. In the illustrated embodiment, the computing device 710 can include one or more input/output (I/O) interface unit(s) 718 that can supply (e.g., transmit or otherwise communicate) at least a portion of the target athletic performance information. It should be appreciated that, in one aspect, the I/O interface(s) 718 can permit direct or indirect communication of information (e.g., athletic performance information, marking information, a combination thereof, or the like) between the computing device 710 and an external device, such as another computing device, e.g., a network element or an end-user device. Such communication can include direct communication or indirect communication, such as an exchange of information between the computing device 710 and the external device via a network or elements thereof.

The target athletic performance information can be imparted to or otherwise embedded on a wearable device in accordance with one or more aspects described herein. In an example scenario in which the running event is a marathon, such a computing device can supply target athletic information with race splits in one-mile increments for a finish time within a specific range of hours—e.g., a finish time between 2 hours (labeled or otherwise represented in a wearable device as "2:00:00") and ten hours (labeled as "10:00:00"). In addition, the supplied target athletic performance information can be embedded on bracelets, for example, in accordance with one or more aspects of the disclosure. An athlete can select or otherwise acquire a bracelet having markings representative or otherwise representative of appropriate athletic performance information to wear during the running event. Appropriate athletic performance can include information indicative or otherwise representative of athletic performance commensurate with physical condition and/or body morphology (shape, weight, height, or the like).

Unit(s), device(s), and processor(s) contained in the computing device 710 can be functionally coupled via a bus architecture (represented with bidirectional arrows). The bus architecture can include at least one of a system bus, a memory bus, an address bus, or a message bus, and can permit the exchange of information (data, metadata, and/or signaling) between the processor(s) 714, the I/O interface unit(s) 718, and/or the memory 722, or respective functional elements therein.

Figure 8:
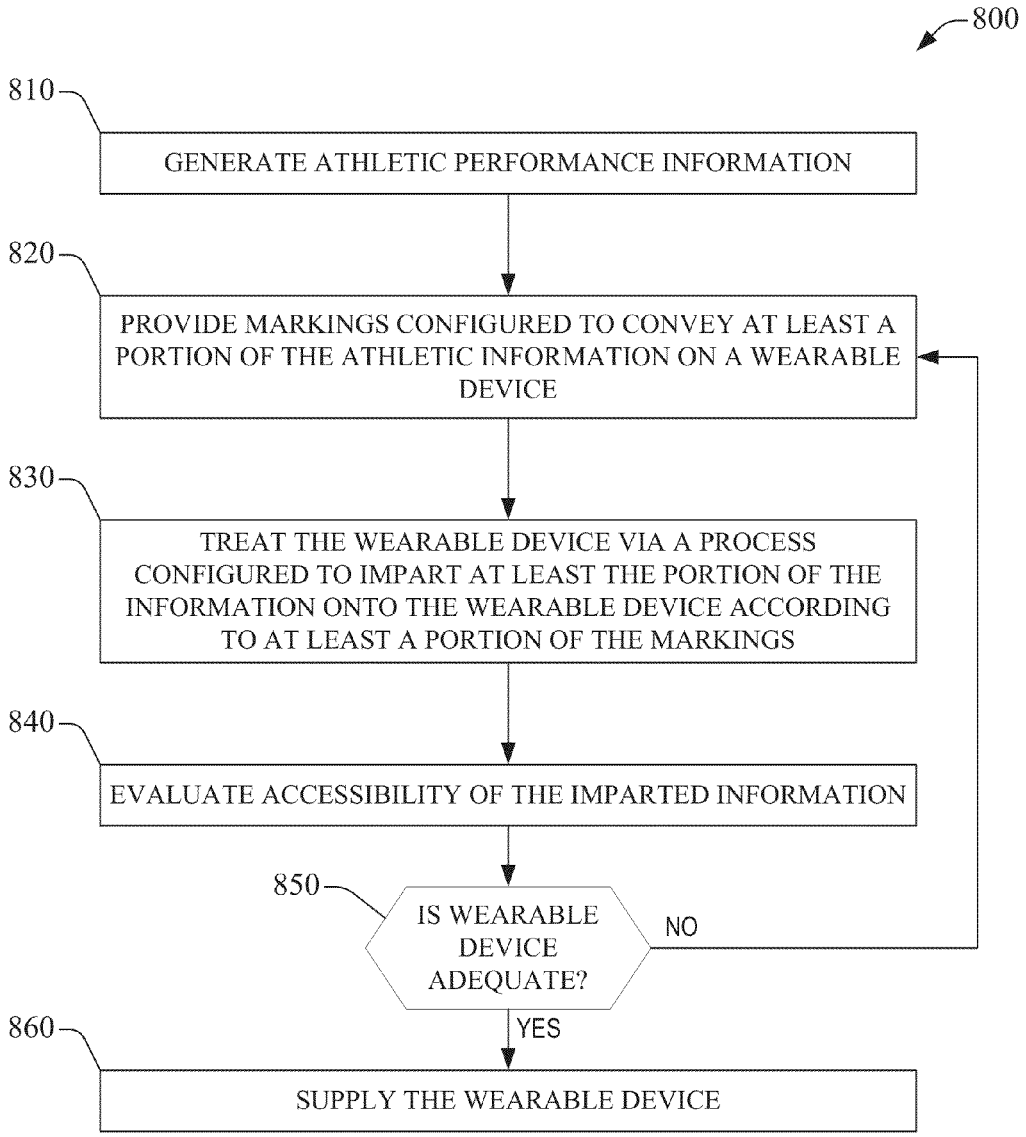
FIGS. 8-9 present flowcharts of example methods in accordance with one or more aspects of the disclosure.
Figure 9:
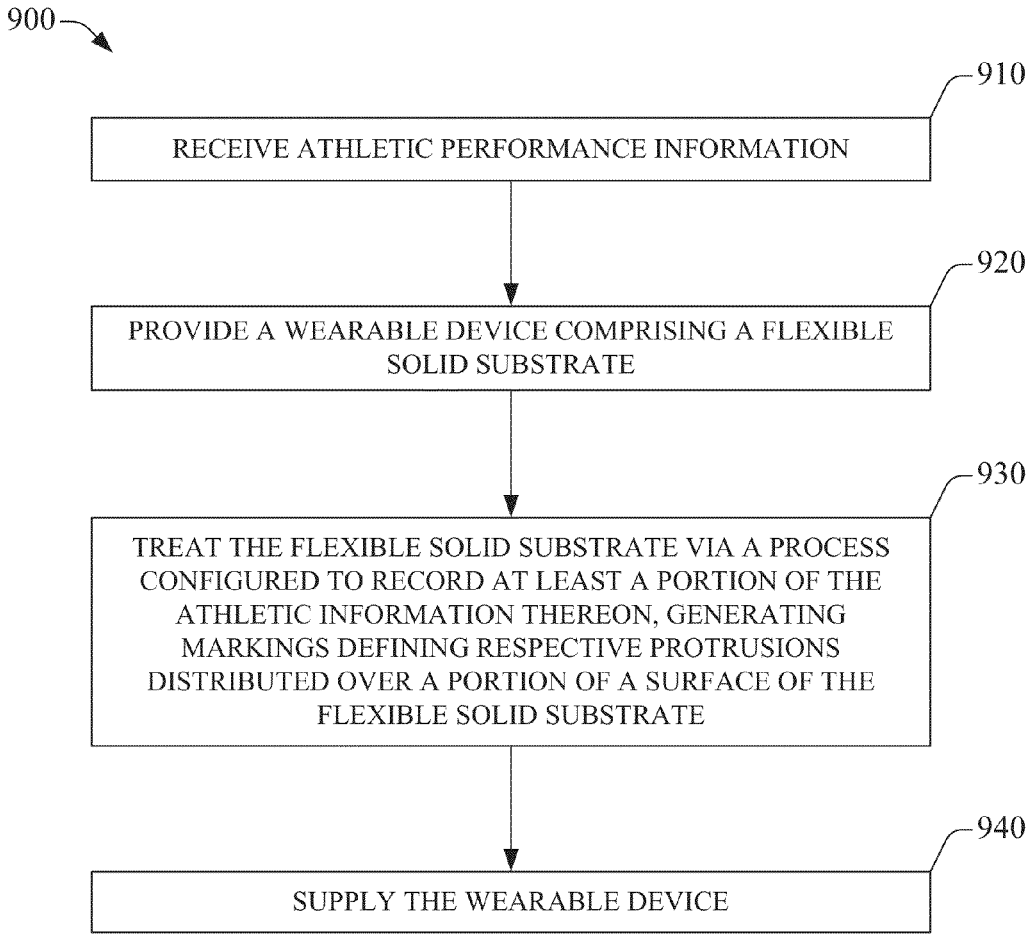

At least some of the techniques described in the present disclosure may be better appreciated with reference to the flowcharts in FIGS. 8-9 directed to example methods 800 and 900, respectively, for supplying a wearable device for assessment of athletic performance according to at least certain aspects of the disclosure. At least a portion of the example method 800 can be implemented (e.g., configured (such as linked, compiled, a combination thereof, or the like); executed; configured and executed) by a computing device having a processor and information storage devices (which also may be referred to as memory devices or memories). In one aspect, such a computing device or one or more processors integrated therein can be employed to execute code instructions retained in a memory, or any computer- or machine-readable medium, to implement the one or more methods. The code instructions can provide a computer-executable or machine-executable framework to implement the methods described herein.

For purposes of simplicity of explanation, the example methods disclosed herein are presented and described as a series of blocks (with each block representing an action or an operation in a method, for example). However, it is to be understood and appreciated that the disclosed methods are not limited by the order of the blocks and associated actions or operations, as some blocks may occur in different orders and/or concurrently with other blocks from those that are shown and described herein. For example, the various methods or processes of the disclosure can be alternatively represented as a series of interrelated states or events, such as in a state diagram. Furthermore, not all illustrated blocks, and associated action(s), may be required to implement a method in accordance with one or more aspects of the disclosure. Further yet, two or more of the disclosed methods or processes can be implemented in combination with each other, to accomplish one or more features or advantages described herein.

It should be appreciated that at least a certain portion of the methods of the disclosure can be retained on an article of manufacture, or computer-readable medium, to permit or facilitate transporting and transferring such methods to a computing device (e.g., a desktop computer; a mobile computer, such as a tablet, or a smartphone; a gaming console; a mobile telephone; a blade computer; a programmable logic controller; and the like) for execution, and thus implementation, by a processor of the computing device or for storage in a memory thereof or functionally coupled thereto.

Regarding the example method 800, at block 810, athletic performance information can be generated. In one aspect, such information can be generated by a computing device having one or more processors functionally coupled to one or more memory devices (e.g., memory 722). As described herein, the athletic performance information can comprise information indicative of a time sequence associated with traveling a predetermined distance during a predetermined time interval. Generating at least a portion of such information can include selecting the predetermined distance, such as a marathon distance, a half-marathon distance, a 10K race distance, 5K race distance, an ultra race distance (e.g., 100 miles), distances respectively associated with the events in a triathlon, track distances, and so forth. A marathon is arguably the hardest to negotiate mathematically for runners trying to stay on pace due to the large number of splits (26.2 miles with 26 mile splits). The predetermined distance can be represented or otherwise conveyed according to the U.S. units of measurement or the International System of Units (typically referred to as SI (Système international d'unités)). It should be appreciated that, in one aspect, while the predetermined distance remains unchanged regardless of the unit system that is employed, a number of race splits associated with the time sequence depends on the units contemplated to represent distance. In an example scenario in which the athletic information is generated for a marathon, 26 race splits (e.g., a split for each whole mile in the marathon) can be associated with a generated time sequence, whereas 42 race splits may be associated with another time sequence in which a split for each whole kilometer in the marathon is contemplated. Accordingly, in one aspect, the athletic performance information that is generated can be dependent on the unit system utilized to assess athletic performance. In addition, in certain aspects, such dependency can establish design considerations that are specific to a selected or otherwise desired unit system. For instance, in the marathon scenario, considering a split per whole kilometer may yield an amount of information that can be illegible when embedded in certain confined spaces, such as the wearable devices in accordance with aspects of the disclosure. For the marathon, in SI units, other race split configurations can provide an amount of information that can be legible when conveyed in such wearable devices.

In one embodiment, the athletic performance information can be generated for race splits (s) at every second and fifth kilometer, and at the half distance—e.g., $s_1$=2 Km, $s_2$=4 Km, $s_3$=5 Km, $s_4$=6 Km, $s_5$=8 Km, $s_6$=10 Km, $s_7$=12 Km, $s_8$=14 Km, $s_9$=15 Km, $s_{10}$=16 Km, $s_{11}$=18 Km, $s_{12}$=20 Km, $s_{13}$=21 Km, $s_{14}$=22 Km, $s_{15}$=24 Km, $s_{16}$=25 Km, $s_{17}$=26 Km, $s_{18}$=28 Km, $s_{19}$=30 Km, $s_{20}$=32 Km, $s_{21}$=34 Km, $s_{22}$=35 Km, $s_{23}$=36 Km, $s_{24}$=38 Km, $s_{25}$=40 Km, $s_{26}$=42 Km—which provides 26 race splits. Selection of a race split configuration can be determined based at least on knowledge of what is important for athletes accustomed to units in the SI.

At block 820, markings configured to convey at least a portion of the athletic information on a wearable device can be provided. In one aspect, at least a portion of such markings or information representative or indicative of such markings can be provided by a computing device (e.g., computing device 710) having one or more processors functionally coupled to one or more memory devices (e.g., memory 722). As described herein, the wearable device can include a flexible substrate (e.g., a silicone substrate, a fibrous substrate, a flexible composite material substrate, a combination thereof, or the like). The flexible substrate can be colored (e.g., pigmented, painted, coated, a combination thereof, or the like) according to a desired or otherwise specified color or combination of colors. In one aspect, providing such markings can comprise selecting or otherwise identifying the markings from a group of currently available markings, e.g., letters and/or numbers according to a specific font or typeface, such as Helvetica or Swiss 721 BlkCn BT. In another aspect, providing the markings can comprise designing the markings. At least a portion of the markings can include letters and/or numbers and, in certain aspects, designing the markings can include designing a font indicative or otherwise representative of at least the portion of the markings In certain implementations, designing such a font can include establishing a font size and/or establishing relative placement of the markings according to the font. It should be appreciated that, in one aspect, a suitable font size and/or relative placement of markings can attain satisfactory (e.g., maximal or nearly maximal) legibility and/or utility of the wearable device. In other implementations, designing the font indicative or otherwise representative of at least the portion of the markings can include establishing shapes for each of the various markings (e.g., letters, numbers, or a combination thereof) represented in accordance with the font. For instance, establishing one or more of such shapes can include evaluating, for example, advantages and disadvantages of boldface fonts vs. non boldface fonts. This had to be done for the different distances and the different units of measure since each impacted the amount of data being placed on the bands.

In addition or in the alternative, identifying a color or arrangement of colors for the markings can be included in designing the markings. In order to identify a color for the substrate and/or at least a portion of the markings, the computing device that implements the subject example method can generate different respective colors or respective color arrangements for the flexible substrate and at least the portion of the markings In one aspect, generating a color can include generating a specific combination of red (R), green (G), and blue (B). For example, a certain shade of yellow might be 6.67% R, 93.33% G, and 0% B. In another aspect, the color that is generated can be translated to the color's international manufacturing counterpart in the Pantone Matching System (PMS) color charts, for example, in order for a manufacturer to produce or otherwise fabricate the wearable device having the desired color or color arrangement. Translating the color from its RGB representation to the color's PMS similar or equivalent can include matching the generated color to a PMS color having an RGB composition that is substantially the same as the generated color's RGB representation, or that is similar to the generated color's RGB representation within a predetermined tolerance.

At block 830, the wearable device can be treated via a process configured to impart at least the portion of the athletic performance information onto the wearable device according to at least a portion of the markings. In certain embodiments, treating the wearable device via such a process can comprise treating at least one surface of the wearable device via the process, where the process can comprise one or more of printing at least the portion of the information onto the at least one surface of the wearable device, or coating at least the portion of the information onto the at least one surface of the wearable device. The printing can include powder-based printing (such as laser printing), ink-based printing (such as inkjet printing), a combination thereof, or the like. In other embodiments, the process can comprise etching, and treating the wearable device via such a process can comprise etching at least the portion of the athletic information into the wearable device with the information. In yet other embodiments, the process can comprise embossing and/or debossing, and treating the wearable device via such a process can comprise embossing the wearable device with at least the portion of the athletic information and/or debossing the wearable device with at least the portion of the athletic information.

At block 840, accessibility of the imparted information can be evaluated. In one aspect, at least a portion of the evaluation can be effected via a computing device (e.g., computing device 710) having one or more processors functionally coupled to one or more memory devices (e.g., memory 722). Accessibility can include legibility of at least the portion of the athletic performance information that is imparted onto the wearable device according to at least the portion of the markings More generally, accessibility can be measured according to an adequacy criterion (e.g., a legibility criterion, a durability criterion, an information-packaging criterion, a combination thereof, or the like). It should be appreciated that, in one aspect, the adequacy criterion is directed to achieving a satisfactory (e.g., optimal or nearly optimal) utility of the wearable device during competition. Accordingly, at block 850, it can be determined if the wearable device satisfies an adequacy criterion in response to evaluating the accessibility of the imparted information. In response to ascertaining that the wearable device does not satisfy the adequacy criterion (e.g., the wearable device is inadequate) flow is redirected to block 820. In the alternative, in response to ascertaining that the wearable device satisfies the adequacy criterion (e.g., the wearable device is adequate) the wearable device is supplied at block 860.

In connection with the example method 900, athletic performance information can be received at block 910. In one aspect, at least a portion of the information can be received by a computing device (e.g., computing device 710) having one or more processors functionally coupled to one or more memory devices (e.g., memory 722). As described herein, the athletic performance information can comprise information indicative of a time sequence associated with traveling a predetermined distance during a predetermined time interval. At block 920, a wearable device comprising a flexible solid substrate can be provided. As described herein, in certain embodiments, the flexible solid substrate can be substantially planar, and can be arranged or otherwise assembled to fit a member (e.g., an extremity or limb) associated with an athlete. For instance, the flexible substrate can be bent to form an opening configured to receive one of the athlete's hand, wrist, and/or forearm.

At block 930, the flexible solid substrate can be treated via a process configured to record at least a portion of the information thereon. Treating the flexible solid substrate can generate markings defining respective protrusions substantially uniformly distributed over a portion of a surface of the flexible solid substrate, and/or non-uniformly distributed over the portion of the surface of such a substrate. In certain embodiments, treating the flexible solid substrate via such a process can comprise treating at least one surface of the flexible solid substrate, where the process can comprise one or more of printing at least the portion of the athletic information onto the flexible solid substrate, or coating at least the portion of the athletic information onto the flexible solid substrate. As described herein, the printing can include powder-based printing (such as laser printing), ink-based printing (such as inkjet printing), a combination thereof, or the like. In other embodiments, the process can comprise etching, and treating the wearable device via such a process can comprise etching at least the portion of the athletic information into the wearable device. In yet other embodiments, the process can comprise embossing and/or debossing, and treating the wearable device via such a process can comprise embossing the wearable device with at least the portion of the athletic information and/or debossing the wearable device with at least the portion of the athletic information.

At block 940, the wearable device can be supplied. It should be appreciated that, in one aspect, the wearable device that is supplied comprises the flexible solid substrate that is treated according to block 930 described herein. In certain embodiments, the wearable device can be formed from or can comprise a silicone bracelet having a length to width aspect ratio ranging from about 6 to about 8. In other embodiments, the wearable device can be formed from or can comprise a neoprene bracelet having a length to width aspect ratio ranging from about 6 to about 8.

Other additional or alternative embodiments of wearable devices and/or methods also are contemplated in the present disclosure. One example of such embodiments includes a wearable device comprising a substrate comprising a flexible solid that is substantially planar; and markings embossed into the substrate and defining respective protrusions substantially uniformly distributed over a portion of a surface of the substrate, and wherein the markings are indicative of a time sequence associated with traveling a predetermined distance during a predetermined time interval. In such a wearable device, the flexible solid can comprise one or more of silicone, a synthetic rubber, or a fibrous material. Another example of such embodiments includes a wearable device, comprising a substrate comprising a flexible solid that is substantially planar; and markings debossed into the substrate and defining respective protrusions substantially uniformly distributed over a portion of a surface of the substrate, and wherein the markings are indicative of a time sequence associated with traveling a predetermined distance during a predetermined time interval. The flexible solid can comprise one or more of silicone, a synthetic rubber, or a fibrous material. Yet another example of such embodiments includes a wearable device comprising a substrate comprising a flexible solid that is substantially planar; and markings printed onto the substrate, at least a portion of the markings being indicative of respective instants of a time sequence associated with traveling a predetermined distance during a predetermined time interval.

In addition, examples of additional or alternative techniques include a method, comprising generating performance information indicative of a time sequence associated with traveling a predetermined distance during a predetermined time interval. In one aspect, the predetermined distance can be associated with a distance of an athletic race or competition. In an additional or alternative aspect, each instant in the time sequence is indicative of a time interval elapsed while traveling a portion of the predetermined distance. The time sequence can comprise a plurality of substantially homogeneously distributed instants, each instant being indicative of a time interval elapsed while traveling a portion of the predetermined distance, and wherein a difference between a first instant and a second instant of the plurality of substantially homogenously distributed instants corresponds to another time interval associated with traveling another predetermined distance. The method also can comprise generating markings configured to provide the information on a wearable device comprising a flexible substrate; and treating the wearable device via a process suitable to impart the information onto the wearable device. In addition, the method can further comprise evaluating the accessibility of the imparted information and, in response to the evaluating, determining if the wearable device satisfies an adequacy criterion. In addition, the method can further comprise supplying the wearable device in response to ascertaining that the adequacy criterion is satisfied. In one aspect, in response to ascertaining that the adequacy criterion is not satisfied, the method can further comprise generating alternative markings configured to provide the information on an alternative wearable device. In addition, the method can further comprise further evaluating the accessibility of the imparted information on the alternative wearable device, and supplying the alternative wearable device in response to ascertaining that the adequacy criterion is satisfied.

Another example embodiment includes a method comprising receiving performance information indicative of a time sequence associated with traveling a predetermined distance during a predetermined time interval; providing a wearable device comprising a flexible solid substrate that is substantially planar; and treating the flexible solid substrate via a process suitable to record the information thereon, thereby generating markings defining respective protrusions substantially uniformly distributed over a portion of a surface of the flexible solid substrate. In certain implementations, the treating comprises treating at least one surface of the flexible solid substrate, and wherein the process comprises printing the information on the wearable device. In other implementations, the treating can comprise treating at least one surface of the flexible solid substrate, and wherein the process comprises coating the information onto the wearable device. In yet other implementations, the treating can comprise embossing the wearable device with the information. In still other implementations, the treating comprises etching the information into the wearable device with the information. In further or alternative implementations, the treating can comprise debossing the wearable device with the information. In addition, the method also can comprise supplying the wearable device, wherein the wearable device comprises a silicone bracelet having a length to width aspect ratio ranging from about 6 to about 8. In the alternative, the method can comprise supplying the wearable device, wherein the wearable device comprises a neoprene bracelet having a length to width aspect ratio ranging from about 6 to about 8.

As it would readily be appreciated, various embodiments of the disclosure may take the form of an entirely or partially hardware embodiment, an entirely or partially software embodiment, or a combination of software and hardware (e.g., a firmware embodiment). Furthermore, as described herein, various embodiments of the disclosure (e.g., methods and systems) may take the form of a computer program product comprising a computer-readable non-transitory storage medium having machine-accessible instructions (e.g., computer-readable and/or computer-executable instructions) such as computer software, encoded or otherwise embodied in such storage medium. Those instructions can be read or otherwise accessed and executed by one or more processors to perform or permit performance of the operations described herein. The instructions can be provided in any suitable form, such as source code, compiled code, interpreted code, executable code, static code, dynamic code, assembler code, combinations of the foregoing, and the like. Any suitable computer-readable non-transitory storage medium may be utilized to form the computer program product. For instance, the computer-readable medium may include any tangible non-transitory medium for storing information in a form readable or otherwise accessible by one or more computers or processor(s) functionally coupled thereto. Non-transitory storage media can include read-only memory (ROM); random access memory (RAM); magnetic disk storage media; optical storage media; flash memory, etc.

At least some embodiments of the methods (or techniques) are described herein with reference to block diagrams and flowchart illustrations of methods, computing devices, apparatuses and/or computer program products. It can be understood that each block of the block diagrams and flowchart illustrations, and combinations of blocks in the block diagrams and flowchart illustrations, respectively, can be implemented by machine-accessible instructions. In certain implementations (such as in the embodiment described in connection with the computing device 710), the machine-accessible instructions may be loaded or otherwise incorporated into a general purpose computer, special purpose computer, or other programmable information processing apparatus to produce a particular machine, such that at least some or all of the operations or functions specified in the flowchart block or blocks can be implemented in response to execution at the computer or processing apparatus.

Unless otherwise expressly stated, it is in no way intended that any protocol, procedure, process, or method set forth herein be construed as requiring that its acts or steps be performed in a specific order. Accordingly, where a process or method claim does not actually recite an order to be followed by its acts or steps or it is not otherwise specifically recited in the claims or descriptions of the subject disclosure that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; the number or type of embodiments described in the specification or annexed drawings; or the like.

As used in this application, the terms "component," "system," "interface," "unit," "module," and the like are intended to refer to a computer-related entity or an entity related to an operational apparatus with one or more specific functionalities. Such entities may be either hardware, a combination of hardware and software, software, or software in execution. As an example, a component may be, but is not limited to being, a process running on a processor, a processor, an object, an executable portion of software, a thread of execution, a program, and/or a computing device. For example, both a software application executing on a computing device and the computing device can be a component. One or more components may reside within a process and/or thread of execution. A component may be localized on one computing device or distributed between two or more computing devices. As described herein, a component can execute from various computer-readable non-transitory media having various data structures stored thereon. Components can communicate via local and/or remote processes in accordance, for example, with a signal (either analogic or digital) having one or more data packets (e.g., data from one component interacting with another component in a local system, distributed system, and/or across a network such as a wide area network with other systems via the signal). As another example, a component can be an apparatus with specific functionality provided by mechanical parts operated by electric or electronic circuitry that is controlled by a software application or firmware application executed by a processor, wherein the processor can be internal or external to the apparatus and can execute at least a part of the software or firmware application. As yet another example, a component can be an apparatus that provides specific functionality through electronic components without mechanical parts, the electronic components can include a processor therein to execute software or firmware that provides, at least in part, the functionality of the electronic components. An interface can include input/output (I/O) components as well as associated processor, application, and/or other programming components. The terms "component," "system," "interface," "unit," and "module," can be utilized interchangeably and can be referred to collectively as functional elements.

In the present specification and annexed drawings, reference to a "processor" is made. As utilized herein, a processor can refer to any computing processing unit or device comprising single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit (IC), an application-specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions described herein. A processor can be implemented as a combination of computing processing units. In certain embodiments, processors can utilize nanoscale architectures such as, but not limited to, molecular and quantum-dot based transistors, switches and gates, in order to optimize space usage or enhance the performance of user equipment or other electronic equipment.

In addition, in the present specification and annexed drawings, terms such as "store," "storage," "data store," "data storage," "memory," "repository," and substantially any other information storage component relevant to the operation and functionality of a component of the disclosure, refer to "memory components," entities embodied in a "memory," or components forming the memory. It can be appreciated that the memory components or memories described herein embody or comprise non-transitory computer storage media that can be readable or otherwise accessible by a computing device. Such media can be implemented in any methods or technology for storage of information such as computer-readable instructions, information structures, program modules, or other information objects. The memory components or memories can be either volatile memory or non-volatile memory, or can include both volatile and non-volatile memory. In addition, the memory components or memories can be removable or non-removable, and/or internal or external to a computing device or component. Examples of various types of non-transitory storage media can comprise hard-disc drives, zip drives, CD-ROM, digital versatile disks (DVDs) or other optical storage, magnetic cassettes, magnetic tape, magnetic disk storage or other magnetic storage devices, flash memory cards or other types of memory cards, cartridges, or any other non-transitory medium suitable to retain the desired information and which can be accessed by a computing device.

As an illustration, non-volatile memory can include read-only memory (ROM), programmable ROM (PROM), electrically programmable ROM (EPROM), electrically erasable ROM (EEPROM), or flash memory. Volatile memory can include random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM). The disclosed memory components or memories of operational environments described herein are intended to comprise one or more of these and/or any other suitable types of memory.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

What has been described herein in the present specification and annexed drawings includes examples of devices and techniques that can provide assessment of athletic performance during an athletic event. It is, of course, not possible to describe every conceivable combination of elements and/or methods for purposes of describing the various features of the disclosure, but it can be recognized that many further combinations and permutations of the disclosed features are possible. Accordingly, it may be apparent that various modifications can be made to the disclosure without departing from the scope or spirit thereof. In addition or alternatively, other embodiments of the disclosure may be apparent from consideration of the specification and annexed drawings, and practice of the disclosure as presented herein. It is intended that the examples put forward in the specification and annexed drawings be considered, in all respects, as illustrative and not restrictive. Although specific terms are employed herein, they are used in a generic and descriptive sense only and not for purposes of limitation.

What is claimed is:

1. A method, comprising:

generating performance information indicative of a time sequence associated with traveling a predetermined distance during a predetermined time interval;

generating markings configured to provide the information on a wearable device comprising a flexible substrate; and treating the wearable device via a process suitable to impart the information onto the wearable device.

2. The method of claim 1, further comprising evaluating accessibility of the imparted information and, in response to the evaluating, determining if the wearable device satisfies an adequacy criterion.

3. The method of claim 2, further comprising supplying the wearable device in response to ascertaining that the adequacy criterion is satisfied.

4. The method of claim 2, in response to ascertaining that the adequacy criterion is not satisfied, further comprising generating alternative markings configured to provide the information on an alternative wearable device.

5. The method of claim 4, further comprising further evaluating accessibility of the imparted information on the alternative wearable device.

6. The method of claim 5, further comprising supplying the alternative wearable device in response to ascertaining that the adequacy criterion is satisfied.

7. The method of claim 1, wherein the predetermined distance is associated with a distance of an athletic race.

8. The method of claim 1, wherein each instant in the time sequence is indicative of a time interval elapsed traveling a portion of the predetermined distance.

9. The method of claim 1, wherein the time sequence comprises a plurality of substantially homogeneously distributed instants, each instant being indicative of a time interval elapsed traveling a portion of the predetermined distance, and wherein a difference between a first instant and a second instant of the plurality of substantially homogenously distributed instants corresponds to another time interval associated with traveling another predetermined distance.

10. A method, comprising:

receiving performance information indicative of a time sequence associated with traveling a predetermined distance during a predetermined time interval;

providing a wearable device comprising a flexible solid substrate that is substantially planar; and treating the flexible solid substrate via a process suitable to record the information thereon, thereby generating markings defining respective protrusions substantially uniformly distributed over a portion of a surface of the flexible solid substrate.

11. The method of claim 10, wherein the treating comprises treating at least one surface of the flexible solid substrate, and wherein the process comprises printing the information on the wearable device.

12. The method of claim 10, wherein the treating comprises treating at least one surface of the flexible solid substrate, and wherein the process comprises coating the information onto the wearable device.

13. The method of claim 10, wherein the treating comprises embossing the wearable device with the information.

14. The method of claim 10, wherein the treating comprises debossing the wearable device with the information.

15. The method of claim 10, wherein the treating comprises etching the information into the wearable device with the information.

16. The method of claim 10, further comprising supplying the wearable device, wherein the wearable device comprises a silicone bracelet having a length to width aspect ratio ranging from about 6 to about 8.

17. The method of claim 10, further comprising supplying the wearable device, wherein the wearable device comprises a neoprene bracelet having a length to width aspect ratio ranging from about 6 to about 8.

18. A wearable device, comprising:

a substrate comprising a flexible solid that is substantially planar; and markings embossed into the substrate and defining respective protrusions substantially uniformly distributed over a portion of a surface of the substrate, and wherein the markings are indicative of a time sequence associated with traveling a predetermined distance during a predetermined time interval.

19. The wearable device of claim 18, wherein the flexible solid comprises one or more of silicone, a synthetic rubber, or a fibrous material.

20. A wearable device, comprising:

a substrate comprising a flexible solid that is substantially planar; and markings debossed into the substrate and defining respective protrusions substantially uniformly distributed over a portion of a surface of the substrate, and wherein the markings are indicative of a time sequence associated with traveling a predetermined distance during a predetermined time interval.

21. The wearable device of claim 19, wherein the flexible solid comprises one or more of silicone, a synthetic rubber, or a fibrous material.

22. A wearable device, comprising:

a substrate comprising a flexible solid that is substantially planar; and markings printed onto the substrate, at least a portion of the markings being indicative of respective instants of a time sequence associated with traveling a predetermined distance during a predetermined time interval.

* * * * *